United States Patent [19]

Braun et al.

[11] 3,946,771

[45] Mar. 30, 1976

[54] GASOLINE NOZZLE ASSEMBLY

[76] Inventors: Raymond E. Braun, 481 Vassar Lane, DesPlaines, Ill. 60016; Joseph A. Capozzoli, 516 S. Owen, Mount Prospect, Ill. 60056

[22] Filed: Apr. 23, 1975

[21] Appl. No.: 570,576

[52] U.S. Cl. ..... 141/59; 141/290; 141/392

[51] Int. Cl.[2] ..... B67C 3/34

[58] Field of Search ..... 141/52, 59, 97, 290, 310, 141/382–390, 392; 403/50, 51

[56] References Cited

UNITED STATES PATENTS

| | | | |
|---|---|---|---|
| 3,840,055 | 10/1974 | Wostl et al. | 141/392 |
| 3,866,636 | 2/1975 | Lasater | 141/392 |
| 3,867,969 | 2/1975 | Garnett | 141/392 |

*Primary Examiner*—Houston S. Bell, Jr.

*Attorney, Agent, or Firm*—Howard W. Clement; Jerold A. Jacover

[57] ABSTRACT

Disclosed is a novel nozzle assembly adapted to pass fluid, by means of a fluid outlet line, into any one of a plurality of tank lines, each of the tank lines defining a tank line port. The nozzle assembly is further adapted to receive vapors passing through the tank line port from any one of the tank lines.

11 Claims, 8 Drawing Figures

FIG. 6
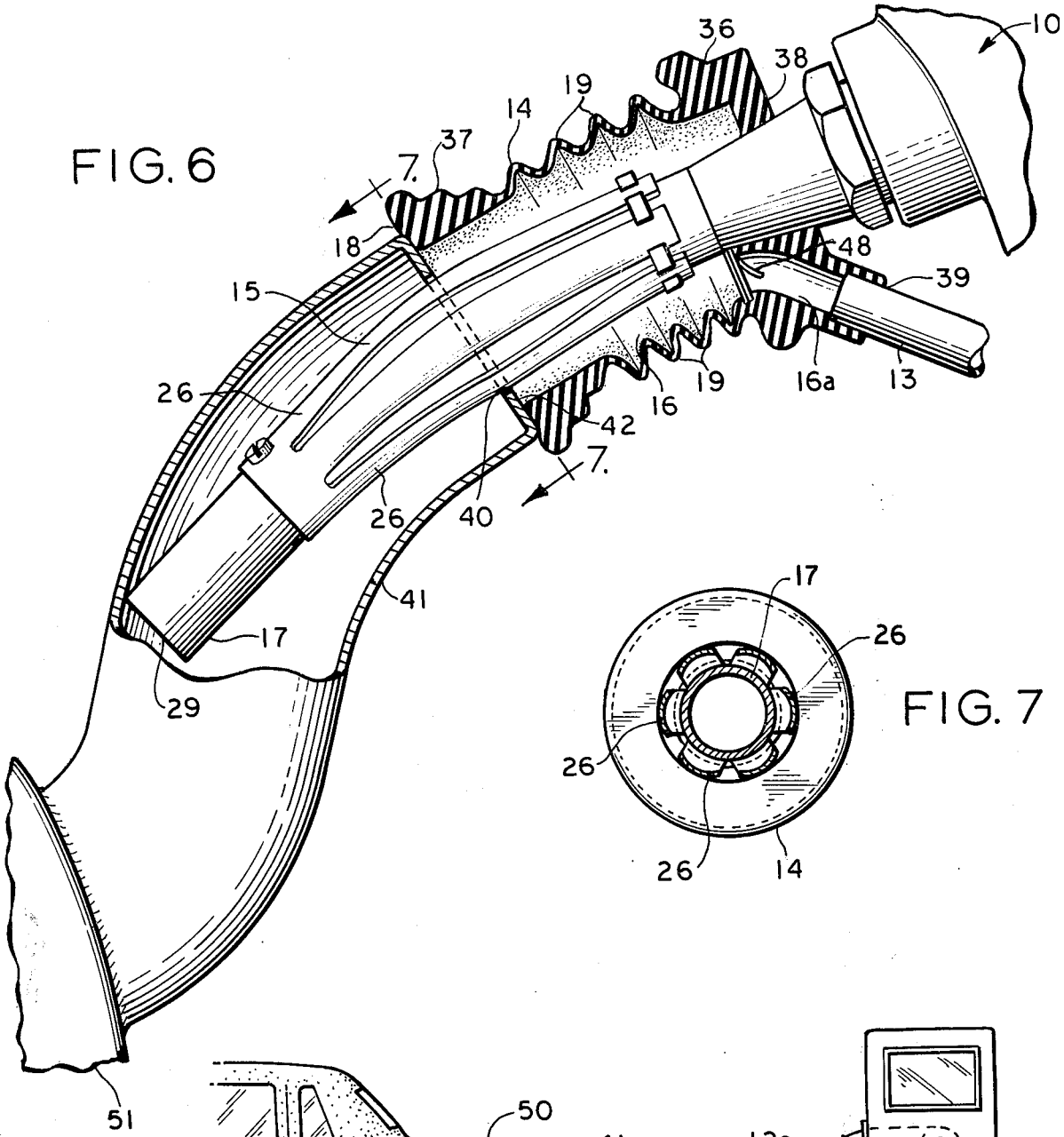
FIG. 7
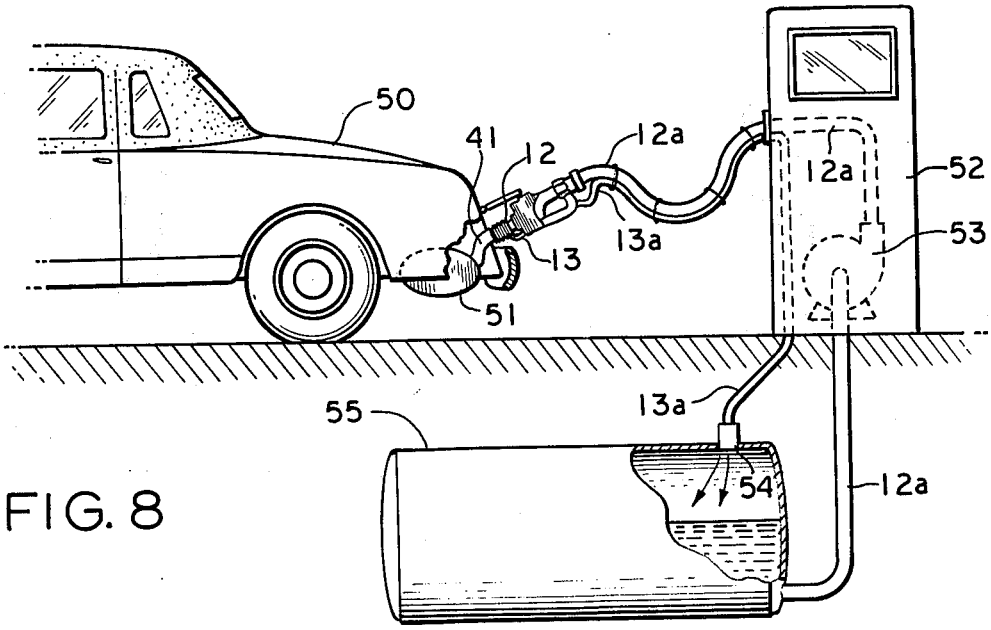
FIG. 8

GASOLINE NOZZLE ASSEMBLY

BACKGROUND OF THE INVENTION

This invention generally relates to improvements in nozzle assemblies used for controllably dispensing volatile fluids such as gasoline. The improved nozzle assembly preferably forms part of a vapor recovery system for capturing fumes displaced by gasoline in liquid form. The system includes means for pumping gasoline from an underground storage tank through an outlet line to a fluid line inlet port leading to the tank of a vehicle such as the gasoline tank of an automobile. The vapor recovery system further includes a fluid return line, isolated from the outlet line, adapted to pass fumes which collect in the vehicular tank to the storage tank. Such a system thus reduces pollution by capturing fumes in the storage tank instead of permitting them to escape into the ambient air. The system also conserves gasoline since the fumes, displaced by the gasoline entering the vehicular tank, are returned to the storage tank via the return line. Inside the storage tank the fumes may condense and thereafter be pumped as gasoline in liquid form through the outlet line to the tank of another vehicle.

The prior art teaches numerous systems which disclose the general concept of returning fumes collected in a vehicular tank, to a storage tank. For the most part, however, such systems have not met with great commercial success. One reason for this lack of success is that many systems of the prior art required nozzle assemblies which were either cumbersome, costly or difficult to install. Another drawback in some prior art systems is that the nozzle assemblies were ineffective in maintaining a proper seal with the fluid inlet port of the vehicular tank to prevent fumes from escaping into the ambient air during fill up. This problem was compounded by the fact that different makes and models of vehicles had fluid inlet ports of different sizes, shapes and locations.

It is thus an object of this invention to provide an improved nozzle assembly which is of relatively simple construction, inexpensive, and effective. It is another object of this invention to provide such a nozzle assembly which can be made by simply and inexpensively modifying existing assemblies. It is still another object of the invention to provide an improved nozzle assembly with the features and advantages recited, which is further capable of maintaining a proper seal with the various fluid inlet ports associated with different makes and models of vehicles. It is anticipated that the nozzle assembly of the invention will be used in connection with a vapor recovery system to conserve gasoline and reduce pollution, though other uses also exist.

SUMMARY OF THE INVENTION

The objects, features and advantages of the invention are achieved in a nozzle assembly adapted to engage any one of a plurality of fluid lines sometimes referred to herein as gasoline tank lines. The assembly comprises a fluid outlet line adapted to pass fluid into any one of the tank lines, each of the tank lines defining a tank line port. The nozzle assembly is further adapted to receive vapors passing through the tank line port from any of the tank lines, and includes spring means, secured to the fluid outlet line, having a member spaced therefrom. The member is adapted to be compressed toward the fluid outlet line upon insertion into any one of the tank lines for applying a force against the tank line to help maintain the fluid outlet line therein. The nozzle assembly also includes a collar means, surrounding a portion of the fluid outlet line and overlapping at least a portion of the spring means. The collar means have a distal end, secured to the fluid outlet line, and a free proximal end, terminating in lip means adapted to form a seal about the tank line port upon insertion of the fluid outlet line into the tank line. The nozzle assembly includes vapor return means, at least partially defined by a space between the collar means and the fluid outlet line, for passing vapors from the tank line.

BRIEF DESCRIPTION OF THE DRAWINGS

The invention summarized above can be best understood by reading the following detailed description in conjunction with the accompanying drawings in which:

FIG. 6 is a sectional view of a portion of the nozzle assembly shown in FIG. 1 in cooperating engagement with a fluid line inlet port;

FIG. 7 is a sectional view taken along lines 7—7 of FIG. 6; and

FIG. 8 is a schematic diagram illustrating the nozzle assembly of FIG. 1 used as part of a gasoline conservation and pollution prevention system.

DETAILED DESCRIPTION OF AN EXEMPLARY EMBODIMENT

Figure 1:
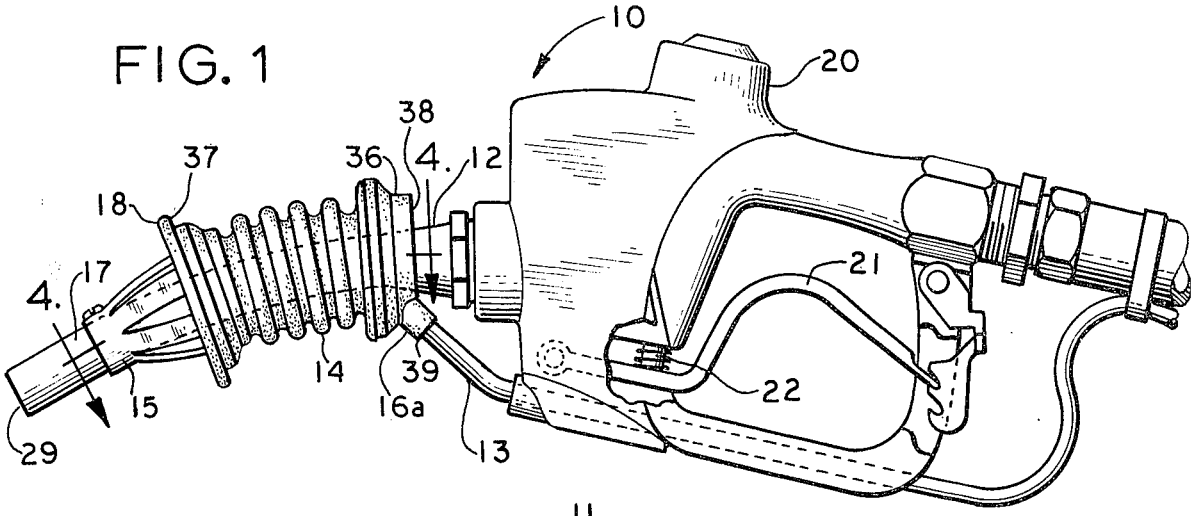
FIG. 1 is a side view of an exemplary embodiment of a nozzle assembly incorporating the invention.
Figure 2:
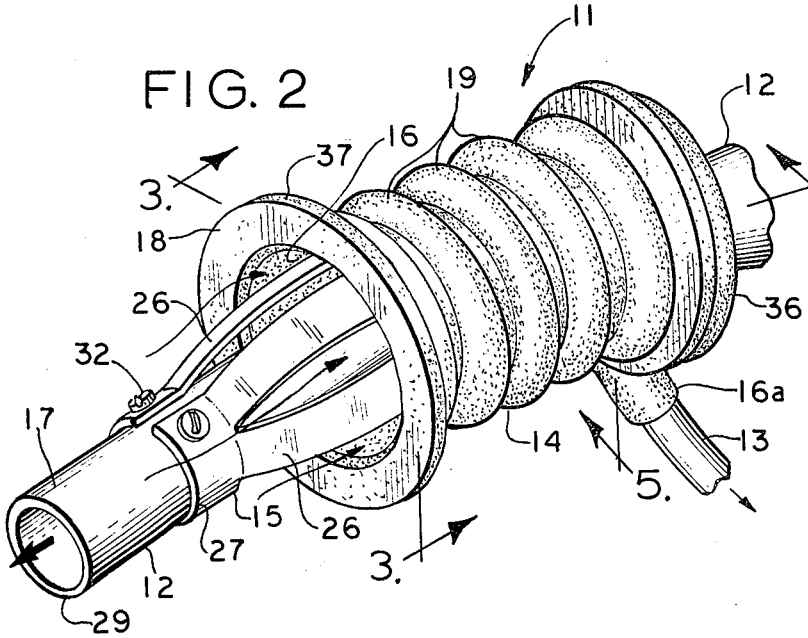
FIG. 2 is an enlarged, perspective view of a portion of the nozzle assembly shown in FIG. 1.
Figure 5:
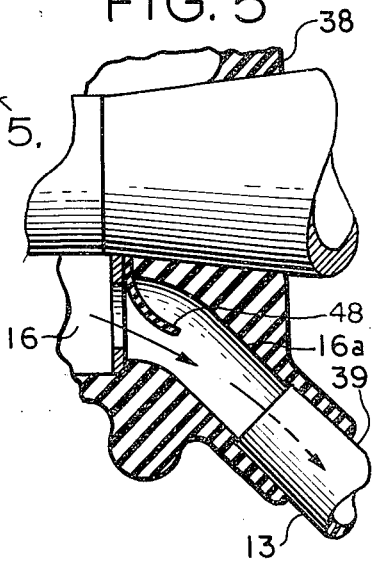
FIG. 5 is an enlarged, sectional view, partially cutaway, taken along lines 5—5 of FIG. 2.
Figure 3:
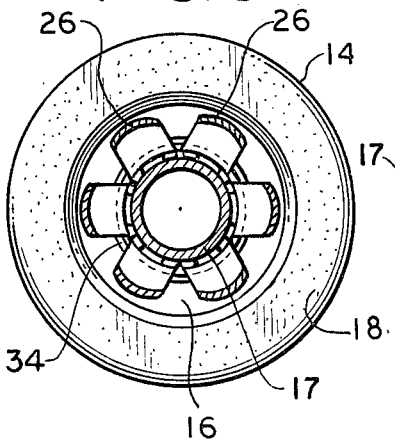
FIG. 3 is a sectional view taken along lines 3—3 of FIG. 2.
Figure 4:
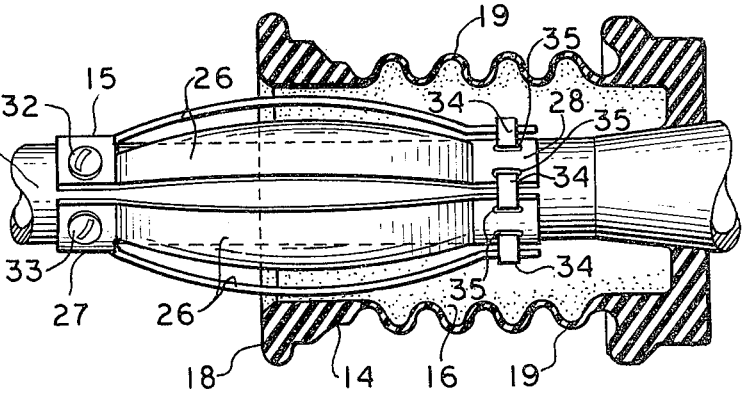
FIG. 4 is a sectional view taken along lines 4—4 of FIG. 1.

Referring now to the drawings, and in particular to FIGS. 1–7, an exemplary embodiment of the nozzle assembly of the invention is represented generally by reference numeral 10. Nozzle assembly 10 includes a housing 20 and an outlet line 12. As will be explained in greater detail in connection with the description of FIG. 8, nozzle assembly 10 is preferably used as part of a vapor recovery system to conserve gasoline and reduce pollution.

Housing 20 typically supports a trigger mechanism 21 adapted to actuate a spring-biased rod 22. Upon actuation, rod 22 renders nozzle assembly 10 in condition to pass volatile fluids such as gasoline through outlet line 12. As shown best in FIGS. 1 and 2, outlet line 12 has an end 17 defining an opening 29, and is of slightly arcuate shape to facilitate the insertion of end 17 into a vehicular tank such as the gasoline tank of an automobile.

Nozzle assembly 10 further includes urging means in the form of a spring 15. Spring 15 has a plurality of members 26 bowed between a pair of end bands 27, 28. In this exemplary embodiment, band 27, which is closest to opening 29 of outlet line 12, is secured thereto by a pair of screws 32, 33, and band 28, which is furthest from opening 29, is preferably slidably fit around outline 12 by any suitable means such as metal clasps stitched through openings 35 in band 28. Though it is preferred that springs 15 be about 4 inches long, and band 27 be secured approximately 1½ inches from opening 29, these dimensions should not be construed as limitative.

Surrounding portions of outlet line 12 and spring 15 are coupling means which may be in the form of an accordion collar 14 characterized by a plurality of folds or pleats 19. Coller 14 is preferably fabricated from a resilient material, such as neoprene, or fitted with a coil spring (not shown) to provide additional resiliency along its longitudinal axis. The collar 14 further defines return means 16 which, in this exemplary embodiment, include the annular space between outlet line 12 and collar 14, and a molded passageway 16*a*. Passageway 16*a* terminates in a return line aperture 39 adapted to receive a return line 13. Thus, nozzle assembly 10 includes two passages for passing fluid—outlet line 12 and return means 16.

Collar 14 has a free proximal end 37, defining a lip 18, disposed nearest opening 29 of outlet line 12, and a distal end 36 disposed furthest from opening 29. Distal end 36 defines an outlet line aperture 38 which is of such diameter as to snugly accommodate outlet line 12, preferably within about 1 inch of housing 20. In this manner, collar 14 is secured to outlet line 12 of nozzle assembly 10 in a normally relaxed state. When collar 14 is so relaxed, it is in an extended position illustrated by FIG. 4. In such a condition, lip 18 is generally within approximately 2 inches of band 27. Collar 14 can also be urged into a retracted position, as illustrated by FIG. 6, to effect a seal between lip 18 of collar 14 and any one of a plurality of fluid line inlet ports such as the part 40 of an automobile gasoline tank line 41. When collar 14 is urged into this retracted position, lip 18 is generally more than approximately 2 inches from opening 29 of outlet line 12.

In an alternative embodiment, collar 14 can be initially held in its retracted position by frictional engagement with members 16 of spring 15. Upon insertion of fluid outlet line 12 into port 40, members 26 are compressed, allowing collar 14 to be urged towards its retracted position, thereby causing lip 18 to be sealed about port 40.

As shown best in FIG. 6, return line 13 is snugly accommodated by return line aperture 39 to produce a leakproof connection with collar 14. Thus, a fume return path is provided from gasoline tank line 41, through fluid line inlet port 40, return means 16, and return line aperture 39, to return line 13. Disposed in return means 16 of collar 14 is a check valve 48 which serves to pass fumes flowing through collar 14 to return line 13, but block the passage of fumes flowing in the opposite direction. Accordingly, once the fumes pass through check valve 48, they are generally unable to return to gasoline tank line 41.

It should be recalled that trigger mechanism 21 is operated to initiate the flow of gasoline through outlet line 12. In general, however, this is not done until outlet line 12 sufficiently enters fluid line inlet port 40 to bring lip 18 into sealed relationship with gasoline tank line 41. The outward flow of gasoline from opening 29 of outlet line 12 into gasoline tank line 41 then prevents fumes emanating therefrom, from entering opening 29 and passing through outlet line 12. Instead, the fumes passing upwardly from gasoline tank line 41 will follow the fume path defined by return means 16 and return line 13 described above.

Referring now to FIG. 8, the operation of assembly 10 as part of a vapor recovery system can be explained. In particular, FIG. 8 illustrates a gasoline pumping station 52 having a pump 53. Pump 53 is connected via a fluid outlet line extension 12*a* to fluid outlet line 12 of nozzle assembly 10. Fluid outlet line extension 12*a* is coupled through pump 52 to a stationary gasoline storage tank 55. Disposed in the top of storage tank 55 is a fume return opening 54. A return line extension 13*a* is coupled between return line 13 and fume return opening 54 to facilitate the passage of fumes into gasoline storage tank 55.

In operation, an automobile 50, having a near-empty gasoline tank 51 is driven into close proximity to pumping station 52. Fluid outlet line 12 of nozzle assembly 10 is then inserted into fluid line inlet port 40 of gasoline tank line 41. More particularly, fluid outlet line 12 is moved a sufficient distance into gasoline tank line 41 to urge collar 14 into its retracted position from its relaxed position. Thus, as shown in FIG. 6, lip 18 forms a tight seal with gasoline tank line 41 to prevent fumes, collected inside gasoline tank 51 from escaping into the ambient air. Trigger mechanism 21 is then operated to allow gasoline to be pumped from storage tank 55, through fluid outlet line extension 12*a* and fluid outlet line 12, into gasoline tank 51. As gasoline in liquid form passes into gasoline tank 51, it displaces the fumes accumulated therein. These fumes are then urged through gasoline tank line 41, return means 16, return line 13, and return line extension 13*a* to storage tank 55.

In storage tank 55, the fumes tend to condense into liquid gasoline which is stored in storage tank 55 until pumped via lines 12*a* and 12 into the gasoline tank of another vehicle. Check valve 48, of course, prevents the fumes from passing to the tank of another vehicle in a gaseous state via lines 13*a* and 13. The recovery system thus conserves gasoline while reducing pollution by preventing fumes from escaping into the ambient air.

To maintain lip 18 of collar 14 properly sealed with gasoline tank line 41, fluid outlet line 12 of nozzle assembly 10 should be inserted into gasoline tank line 41 as shown in FIG. 6. More particularly, the end 17 of fluid outlet line 12 should be urged into contact with the interior of gasoline tank line 41. When such contact is made, the bowed members 26 of spring 15 apply force against the edge of gasoline tank line 41 defining fluid inlet port 40 as shown in FIG. 7. This force, along with the weight of nozzle assembly 10, causes the end 17 of fluid outlet line 12 inside gasoline tank 41 to pivot, thereby increasing the friction between end 17 and gasoline tank line 41. Accordingly, spring 15 helps prevent fluid outlet line 12 from spontaneously withdrawing from fluid line inlet port 40, and assures a proper seal between lip 18 and fluid line inlet port 40 during the fill up of gasoline tank 51. Moreover, spring 15 automatically adjusts to various sized fluid line inlet ports, and permits nozzle assembly 10 to be used with almost every vehicle make and model.

Not only is nozzle assembly 10 adaptable for virtually every vehicle, but it can be produced with only a few simple modifications of existing gasoline pump nozzles, such as Model No. 1 manufactured by the Cardinal Manufacturing Company of St. Louis, Mo. For example, distal end 36 of collar 14 is first slipped over end 17 and onto the arcuate portion of fluid outlet line 12. Next, band 28 of spring 15 is slid along the same arcuate portion of fluid outlet line 12 until positioned under a portion of collar 14. Band 27 is then aligned with predrilled holes in fluid outlet line 12, and attached thereto with screws 32, 33. Finally, the return line 13 coupled to storage tank 55 via return line extension 13*a*, is secured to return line aperture 39 of collar 14.

In view of the foregoing, it should be apparent that nozzle assembly 10 overcomes many of the drawbacks and deficiencies of the prior art. It should also be apparent, however, that those skilled in the art will be able to devise numerous refinements and variations in the exemplary embodiment herein disclosed, without departing from the true scope of the invention. Accordingly, all such refinements and variations are intended to be covered by the appended claims.

We claim:

1. A nozzle assembly adapted to pass fluid, by means of a fluid outlet line, into any one of a plurality of tank lines, each of said tank lines defining a tank line port; said nozzle assembly being further adapted to receive vapors passing through said tank line port from any of said tank lines, the invention comprising:

spring means, secured to said fluid outlet line, having a member spaced therefrom; said member being adapted to be compressed toward said fluid outlet line upon insertion of said fluid outlet line into any one of said tank lines for applying a force against said tank line to help maintain said fluid outlet line therein;

collar means, surrounding a portion of said fluid outlet line and overlapping at least a portion of said spring means, said collar means having a distal end, secured to said fluid outlet line, and a free proximal end, terminating in lip means adapted to form a seal about said tank line port upon insertion of said fluid outlet line into said tank line; and vapor return means, at least partially defined by a space between said collar means and said fluid outlet line, for passing vapors from said tank line, whereby fluid may be passed from said fluid outlet line into said tank line, and vapors may be passed from said tank line into said vapor return means.

2. The nozzle assembly set forth in claim 1 wherein said member spaced from said fluid outlet line is bowed outwardly therefrom, and is adapted to frictionally engage the interior of said tank line to help maintain said lip means in sealed relationship about said tank line port.

3. The nozzle assembly set forth in claim 2 wherein said spring means include a plurality of bowed members spaced from said fluid outlet line, and wherein at least some of said bowed members define gaps therebetween to permit passage of said vapors from said tank line to said vapor return means.

4. The nozzle assembly set forth in claim 1 wherein said coller means include a plurality of pleats to permit the extension and retraction of said coller means relative to said fluid outlet line.

5. The nozzle assembly set forth in claim 1 wherein said collar means are resilient so that, upon retraction, said collar means are urged in the direction opposed to said retraction to help maintain said lip means in sealed relationship about said tank line port upon insertion of said fluid outlet line into said tank line.

6. The nozzle assembly set forth in claim 1 wherein said collar means include integral passage means at said distal end; said integral passage means forming part of said vapor return means.

7. The nozzle assembly set forth in claim 6 wherein said vapor return means include a return line cooperating with said integral passage means for passing said vapors from said nozzle assembly.

8. The nozzle assembly set forth in claim 7 further including valve means, communicating with said vapor return means, for permitting the passage of said vapors from said tank line to said return line, and blocking the passage of said vapors from said return line to said tank line.

9. A nozzle assembly adapted to pass fluid, by means of a fluid outlet line, into any one of a plurality of tank lines, each of said tank lines defining a tank line part; said nozzle assembly being further adapted to receive vapors passing through said tank line port from any of said tank line, the invention comprising:

spring means, secured about at least a portion of said fluid outlet line, including a plurality of members bowed outwardly from said fluid outlet line; said bowed members being adapted to be compressed toward said fluid outlet line upon insertion of said fluid outlet line into any one of said tank lines for applying a force against said tank line to help maintain said fluid outlet line therein;

collar means, surrounding a portion of said fluid outlet line and overlapping at least a portion of said spring means, said coller means having a distal end, secured to said fluid outlet line, and a free proximal end, terminating in lip means adapted to form a seal about said tank line port upon insertion of said fluid outlet line into said tank line; and vapor return means, at least partially defined by a space between said collar means and said fluid outlet line, for passing vapors from said tank line, whereby fluid may be passed from said fluid outlet line into said tank line, and vapors may be passed from said tank line into said vapor return means.

10. A nozzle assembly adapted to pass fluid, by means of a fluid outlet line, into any one of a plurality of tank lines, each of said tank lines defining a tank line port; said nozzle assembly being further adapted to receive vapors passing through said tank line port from any of said tank lines, the invention comprising:

spring means, secured about at least a portion of said fluid outlet line, having a plurality of members defining gaps therebetween to permit passage of said vapors; each of said members being spaced from said fluid outlet line, and being adapted to be compressed upon insertion of said fluid outlet line into any one of said tank lines for applying a force against said tank line to help maintain said fluid outlet line therein;

collar means, surrounding portion of said fluid outlet line and overlapping at least a portion of said spring means, said collar means having a distal end, secured to said fluid outlet line, and a free proximal end, terminating in lip means adapted to form a seal about said tank line port upon insertion of said fluid outlet line into said tank line; and vapor return means, at least partially defined by a space between said collar means and said fluid outlet line, for passing vapors from said tank line, whereby fluid may be passed from said fluid outlet line into said tank line, and vapors may be passed from said tank line into said vapor return means.

11. A nozzle assembly adapted to pass fluid, by means of a fluid outlet line, into any one of a plurality of tank lines, each of said tank lines defining a tank line port; said nozzle assembly being further adapted to receive vapors passing through said tank line port from any of said tank lines, the invention comprising:

spring means, secured to said fluid outlet line, having a member spaced therefrom; said member being adapted to be compressed toward said fluid outlet line upon insertion of said fluid outlet line into any one of said tank lines for applying a force against said tank line to help maintain said fluid outlet line therein;

retractable collar means, surrounding a portion of said fluid outlet line and overlapping at least a portion of said spring means, said colalr means having a distal end, secured to said fluid outlet line, and a free proximal end, terminating in lip means adapted to form a seal about said tank line port upon insertion of said fluid outlet line into said tank line; said collar means being resilient so that, upon retraction, said collar means are urged in the direction opposed to said retraction; said spring means being urged against said collar means, prior to the insertion of said fluid outlet line into said tank line, to help maintain said collar in a retracted position, and said spring means, upon compression, permitting said collar means to be urged in the direction opposed to said retraction so that said lip means are maintained in sealed relationship about said tank line port when said fluid outlet line is thereafter inserted into said tank line; and vapor return means, at least partially defined by a space between said collar means and said fluid outlet line, for passing vapors from said tank line, whereby fluid may be passed from said fluid outlet line into said tank line, and vapors may be passes from said tank line into said vapor return means.

* * * * *

UNITED STATES PATENT AND TRADEMARK OFFICE

CERTIFICATE OF CORRECTION

PATENT NO. : 3,946,771

DATED : March 30, 1976

INVENTOR(S) : Raymond E. Braun, et al.

It is certified that error appears in the above-identified patent and that said Letters Patent are hereby corrected as shown below:

In the Specification:

In column 2, line 65, the word "line" should be --let line--

In column 3, line 6, the word"coller" should be --collar--

In column 3, line 31, the word "part" should be --port--

In column 3, line 37, the numeral "16" should be --26--

In column 3, line 39, the word "towards" should be --toward-

In the Claims:

In column 6, line 11, the word "part" should be --port--

In column 6, line 14, the word "line" should be --lines--

In column 6, line 26, the word "coller" should be --collar--

In column 6, line 52, after the word "surrounding" insert the word --a--

In column 8, line 16, the word "passes" should be --passed--

Signed and Sealed this

Twentieth Day of July 1976

[SEAL]

*Attest:*

RUTH C. MASON
*Attesting Officer*

C. MARSHALL DANN
*Commissioner of Patents and Trademarks*